US012129093B2

(12) United States Patent
Cobler

(10) Patent No.: US 12,129,093 B2
(45) Date of Patent: Oct. 29, 2024

(54) LIQUID CONTAINER WITH ANTI-CRUSHING FEATURE

(71) Applicant: Woodstream Corporation, Lancaster, PA (US)

(72) Inventor: David Fletcher Cobler, Etters, PA (US)

(73) Assignees: Woodstream Corporation, Lancaster, PA (US); ICB Pharma Tomasz Swietoslawski, Pawel Swietoslawski Spolka Jawna, Jaworzno (PL)

( * ) Notice: Subject to any disclaimer, the term of this patent is extended or adjusted under 35 U.S.C. 154(b) by 316 days.

(21) Appl. No.: 17/842,170

(22) Filed: Jun. 16, 2022

(65) Prior Publication Data

US 2023/0406593 A1 Dec. 21, 2023

(51) Int. Cl.

| | |
|---|---|
| ***B65D 75/32*** | (2006.01) |
| ***B65D 75/58*** | (2006.01) |
| ***B65D 83/00*** | (2006.01) |

(52) U.S. Cl.

CPC ..... *B65D 75/322* (2013.01); *B65D 75/5811* (2013.01); *B65D 83/0055* (2013.01); *B65D 2575/3209* (2013.01)

(58) Field of Classification Search

CPC . B65D 75/322; B65D 2575/3209; A61J 1/067

See application file for complete search history.

(56) References Cited

U.S. PATENT DOCUMENTS

| | | | | |
|---|---|---|---|---|
| 3,645,423 | A * | 2/1972 | DeGraw | B65D 83/06 222/452 |
| 2014/0283436 | A1* | 9/2014 | Picas Meya | A01M 1/2011 43/131 |
| 2023/0404052 | A1* | 12/2023 | Cobler | A01M 1/02 |
| 2023/0404053 | A1* | 12/2023 | Cobler | A01M 1/2005 |

* cited by examiner

*Primary Examiner* — Paul R Durand
*Assistant Examiner* — Randall A Gruby
(74) *Attorney, Agent, or Firm* — Barley Snyder

(57) ABSTRACT

A mono-dose container comprises a housing defining an internal cavity. The housing includes a first sidewall defining a first interior surface of the internal cavity, and a second sidewall defining a second interior surface of the internal cavity at least partially opposing the first interior surface. A first protrusion extends from the first sidewall into the internal cavity. A second protrusion extends from the second sidewall into the internal cavity and in a direction of the first protrusion. The first and second protrusions define complementary surfaces sized to engage one another and limit relative movement between the first and second protrusions in at least two directions.

10 Claims, 3 Drawing Sheets

LIQUID CONTAINER WITH ANTI-CRUSHING FEATURE

FIELD OF THE INVENTION

The present disclosure relates to fluid containers, and more particularly, to a mono-dose liquid container having an anti-crushing feature.

BACKGROUND

When dispensing fluids from a container, such as a toxic liquid bait used for insect or pest control, it is desirable to easily control the amount of fluid dispensed from the container and/or ensure that the container may be fully emptied in an easy manner by a user. Further, it is desirable to provide a container meeting these needs, while remaining as cost-effective as possible. For example, in the case of mono-dose containers or packages, fluid contained therein is typically expelled by manually compressing or squeezing the container. Excessive compression of the container, however, can result in its plastic deformation, which may limit further control of, and/or prevent, further expulsion of the fluid. This may be particularly problematic when the container does not include, for example, a vent allowing the container to dispense fluid under only the force of gravity.

Accordingly, improved containers are desired which prevent or limit crushing or plastic deformation during dispensing operations, while remaining cost effective and easy to use.

SUMMARY

According to an embodiment of the present disclosure, a mono-dose container comprises a housing defining an internal cavity. The housing includes a first sidewall defining a first interior surface of the internal cavity, and a second sidewall defining a second interior surface of the internal cavity at least partially opposing the first interior surface. A first protrusion extends from the first sidewall into the internal cavity. A second protrusion extends from the second sidewall into the internal cavity and in a direction of the first protrusion. The first and second protrusions define complementary surfaces sized to engage one another and limiting relative movement between the first and second protrusions in at least two directions.

BRIEF DESCRIPTION OF THE DRAWINGS

The invention will now be described by way of example with reference to the accompanying Figures, of which.

DETAILED DESCRIPTION OF THE EMBODIMENTS

Figure 1:
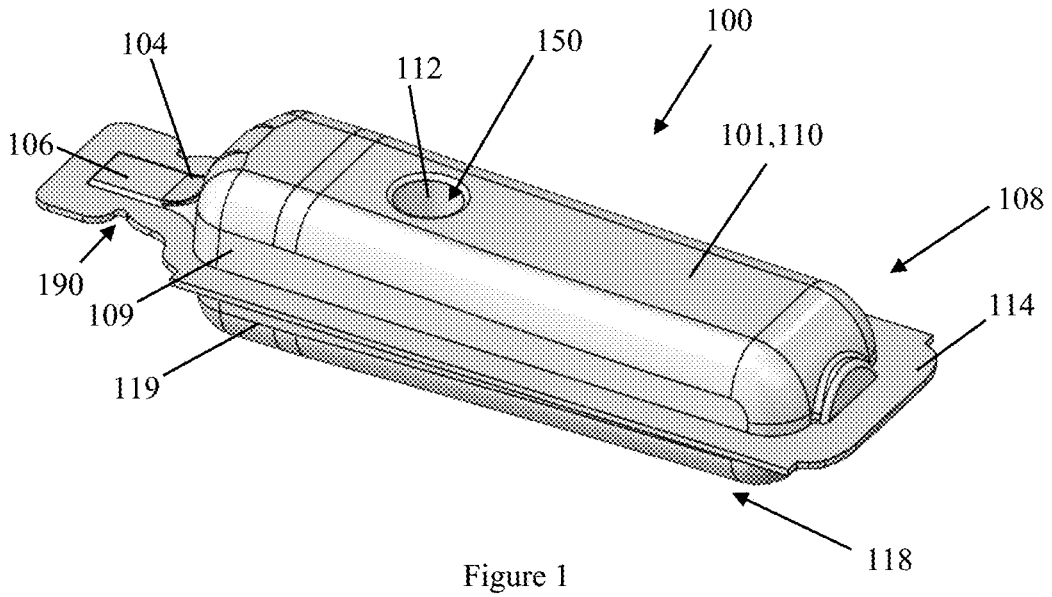
FIG. 1 is a perspective view of a mono-dose container according to an embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Embodiments of the present disclosure include a container adapted to hold and dispense a liquid. More particularly, embodiments include a container having a fluid or liquid-containing cavity with at least one internal protrusion adapted to enable dispensing a liquid contained therein via compression, while preventing the cavity thereof from being crushed. Embodiments of the present disclosure further include a method for dispensing a liquid from the above-described container, including a process of compressing the container until engagement of the internal protrusion(s) and subsequently releasing the container in a repeating pumping action.

Referring generally to FIGS. 1-5, a container 100 according to an embodiment of the present disclosure is shown. The container 100 includes a housing or body 101 defining an internal cavity 102 (see FIG. 2). The internal cavity 102 is arranged in communication with an exit port or passageway 104. A break-away tab 106 is defined proximate an end of the passageway 104, and defines a segment of the housing 101 that is adapted to be removed (e.g., cut or torn by a user). Removal of the tab 106 opens a closed end of the passageway 104 and permits the flow of fluid from the internal cavity 102 to an external environment. In the exemplary embodiment, the container 100 comprises a polymer ampule or vessel formed by, for example, blow-molding a polymer film.

The housing 101 is defined by top and bottom walls 110,120 and associated integral sidewalls forming the internal cavity 102. The top and bottom walls 110,120 are adapted to be pressed together to reduce the volume of the internal cavity 102 for dispensing a liquid contained therein. More specifically, the housing 101 generally defines a first housing half 108 defining the top wall 110, and a second housing half 118 defining the bottom wall 120. The first and second housing halves 108,118 each define an at least partially vertical sidewall 109,119 extending circumferentially about the housing 101. The first and second housing halves 108,118 are joined at a shared joining wall or flange 114 defined about a lateral perimeter of the housing 101. The tab 106 is at least partially defined in the flange 114. A pair of notches 190 may be formed in the flange 114 in the area of the tab 106, promoting the tearing, breaking or cutting of the tab in the correct location prior to use.

The container 100 includes at least one anti-crushing feature adapted to prevent or limit the plastic deformation of the housing 101 by a user while dispensing the contained liquid. Specifically, as the container 100 does not include a vent or a breathing port, the primary means to efficiently dispense liquid from the internal cavity 102 includes compressing at least one of the top or bottom walls 110,120 of the housing 101, and preferably both walls toward one another. This at least partially collapses the internal cavity 102, reducing its volume and expelling the liquid via the open passage 104 via increased internal pressure. In order to ensure that a user can completely expel the liquid in the internal cavity 102, the container must enable a user to repeatedly compress the internal cavity in a pumping-like action. More specifically, the housing 101 is adapted to be only elastically deformed, or at least partially only elastically deformed, under a compressive expulsion force applied by a user. Upon release of the force, the housing 101, and more specifically its opposed top and bottom walls 110,120 thereof, is adapted to at least partially elastically return to its undeformed state (or the volume of the internal cavity 102 return to, or nearer to, its original uncompressed volume), drawing air back into the cavity.

In order to prevent excess plastic deformation (or any plastic deformation) of the housing 101, the container 100 includes at least one anti-crushing or anti-crush feature or structure 150. Specifically, in the exemplary embodiment, each of the opposing top and bottom walls 110,120 includes a respective protrusion 112,122 extending from the respective wall and into the internal cavity 102. As shown, the protrusions 112,122 extend in a direction generally toward one another in an uncompressed state of the housing 101. A predetermined gap or space 140 is defined between the protrusions 112,122 in the uncompressed state of the housing 101.

Deformation of the housing 101 causes relative motion between the top and bottom walls 110,120, reducing the size of the gap 140 in a direction(s) of compression C. After sufficient compression, ends of the protrusions 112,122 will engage with one another, limiting the deformation or compression of the housing 101 in the indicated direction. In this way, the size of the gap or space 140 between the protrusions 112,122 is selected to control the amount of fluid dispensed from the container 100, as well as mechanically limit the amount of deformation of the housing 101, for each compression cycle thereof (i.e., each pump or squeeze). The protrusions 112,122 enable a cyclic pumping operation of the container 100 in order ensure all of the fluid contained therein may be expelled.

Figure 4:
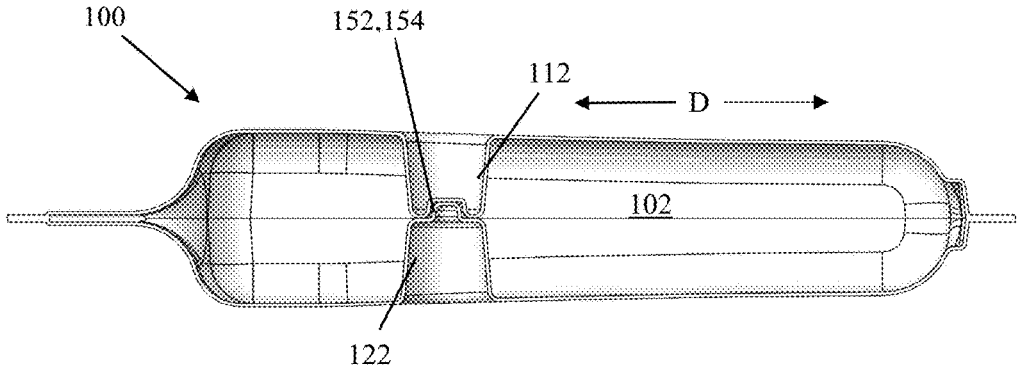
FIG. 4 is a side cross-sectional view of the mono-dose container of the preceding figures in a compressed state.
Figure 5:
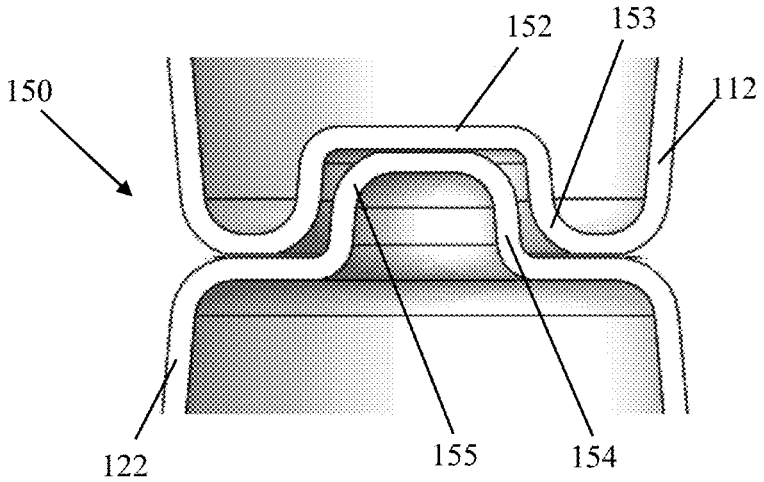
FIG. 5 is a partial side cross-sectional view of the mono-dose container of the preceding figures.

The protrusions 112,122 comprise complementary mating surfaces 152,154 defined on opposing ends thereof. The mating surfaces 152,154 are adapted to engage one another in the compressed state of the housing 101, as shown in FIG. 4. The engaged mating surfaces 152,154 include surfaces which oppose one another at least partially in at least one direction D normal to the directions of compression C of the housing 101. In this way, the positively-engaged mating surfaces 152,154 prevents relative lateral motion of the protrusions 112,122 (or the walls 110,120, or the protrusions "slipping off" one another, under compressive force placed on the container 100 during use. In one embodiment, the engaged mating surfaces 152,154 prevent motion along a plane defined between the mating ends of the protrusions 112,120 (i.e., in all directions within the plane). In other embodiments, the engaged mating surfaces 152,154 prevent motion in at least two directions normal, or relative, to the generally vertical direction(s) of compression.

In the embodiment shown in FIGS. 2-5, the protrusions 112,122 comprise cylinders, or more specifically, tapered cylinders or cones, and the mating surfaces 152,154 comprise a generally cylindrical protrusion having a sidewall and a complementary cylindrical recess having an opposing sidewall, respectively. As shown, the leading surfaces or edges 153,155 of each of the surfaces 152,154 may be rounded so as to facilitate or guide the engagement of the features in use.

In a preferred embodiment, the anti-crushing feature 150 is defined in a front of the housing 101, or toward a front of the housing, proximate the outlet passage 104 in a longitudinal direction of the housing. Further, the housing 101 of the container 100 comprises a generally tapered profile, with a cross-section of the internal cavity 102 being greater toward the front of the housing 101 as compared to a rear of the housing 101 opposite the passage 104. The anti-crushing feature(s) 150 are preferably located centrally within the cavity 102 in a lateral direction of the housing 101, transverse to the longitudinal direction.

Figure 2:
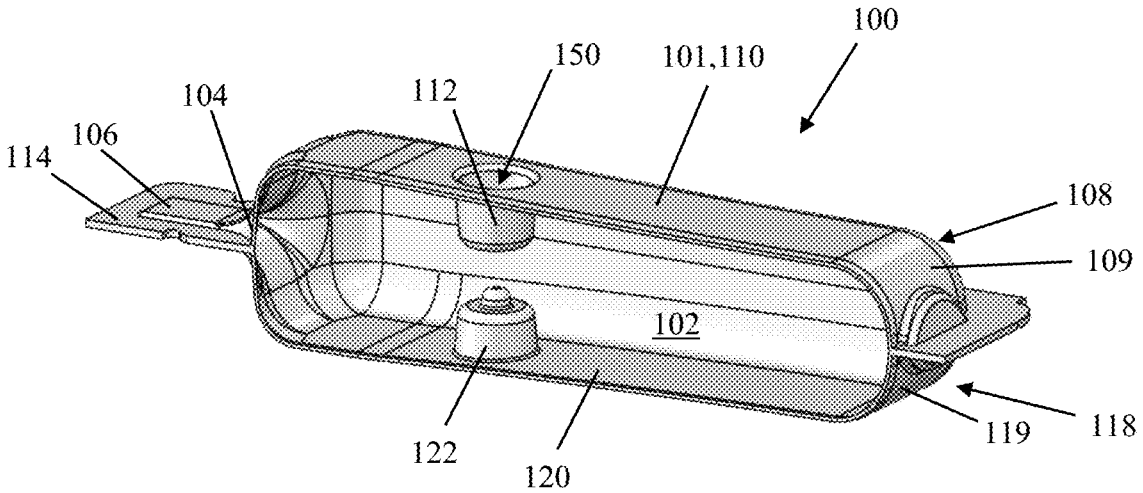
FIG. 2 is a perspective cross-sectional view of the mono-dose container of FIG. 1.
Figure 3:
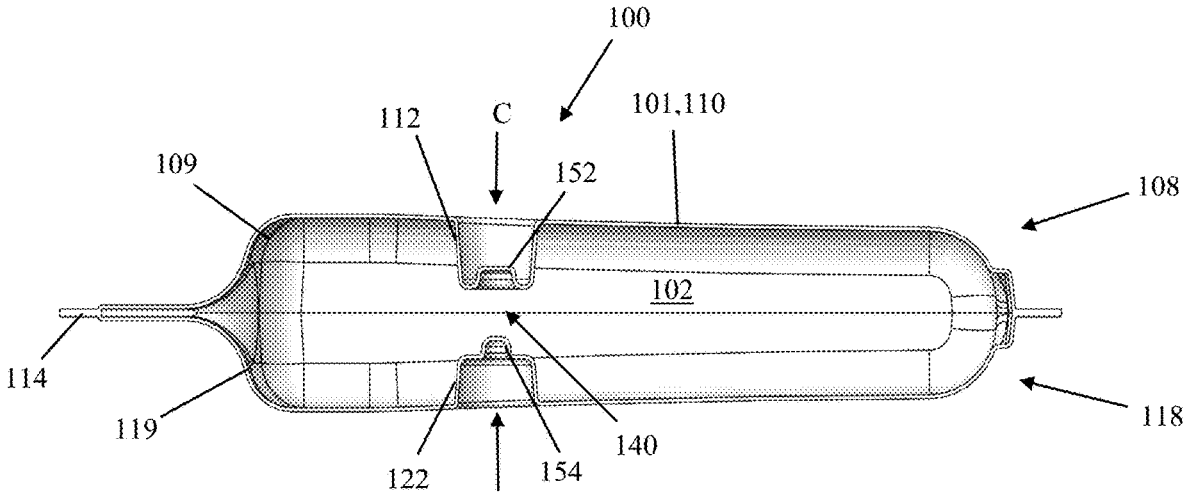
FIG. 3 is a side cross-sectional view of the mono-dose container of the preceding figures.

As set forth above, the housing 101 may be formed by a blow-molding process of manufacture. Specifically, each mirror-image housing halves 108,118 may by formed from a single sheet of polymer film to create the each half. The halves 108,118 are brought into abutment with one another and sealed to one another along a desired sealing line that corresponds with the interior circumferential edges the flange 114 of the housing 101. In one embodiment, an opening is left in the sealing line to provide a fluid input channel. The central area surrounded by the sealed outer edges that will form the internal cavity 102 is also unsealed. In one embodiment, a folded piece of film material sealed is then placed into a two-sided mold that is pre-formed to create the desired bait pack or housing shape including the inner contour of the internal cavity 102, as shown in FIGS. 2-4. Air and product are introduced on the rear end of the pack. The air forces each half 108,118 of the film material outwardly and into abutment with a respective inner side of the mold, forming the single sealed bait cavity 102 having the desired bait pack shape. Insecticide, for example, is then introduced into the internal cavity through the inlet passage 104, after which the tubular member is removed. The fluid inlet passage 104 and flange 114 are then sealed. When the device is ready for use, a neck portion of the inlet passage 104 projects from a remainder of the housing 101, and terminates in the tab portion 106, or beyond a line defined between the score(s) 190. A bait pack having differently shaped sides would be produced using a different pre-formed mold as would be understood by persons of ordinary skill in the art. However, it is preferred that the two halves 108,118 have an identical, or near identical, structure for greater ease and simplicity in manufacture.

Figure 6:
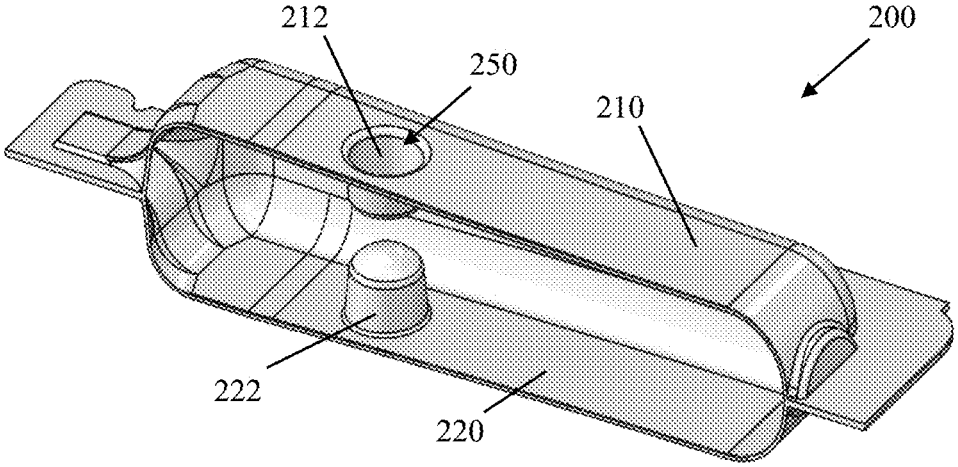
FIG. 6 is a perspective cross-sectional view of a mono-dose container according to an embodiment of the present disclosure.
Figure 7:
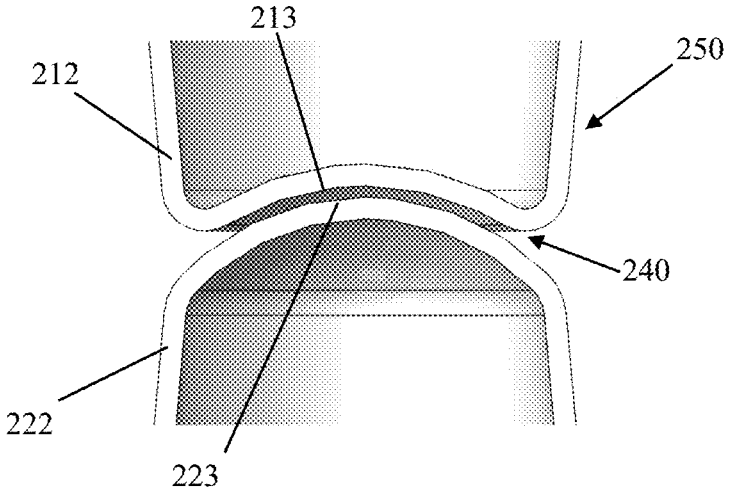
FIG. 7 is a partial side cross-sectional view of the mono-dose container of FIG. 6.

Referring to FIGS. 6 and 7, another embodiment of the present disclosure includes a container 200 having features similar to those described above with respect to FIGS. 1-5. In distinction, an anti-crushing feature 250 includes protrusions 212,222 defining complementary domed shaped, opposing ends or mating surfaces 213,223 (i.e., convex and concave end surfaces). As shown in FIG. 7, once engaged and the gap 240 eliminated, the protrusions 212,222 prevent the above-described lateral relative motion of the protrusions and their respective sidewalls 210,220 in all lateral directions relative to, or all directions normal to, the direction(s) of compression (as shown in the preceding figures) under a force applied by a user. As with the embodiment of FIGS. 1-5, the rounded nature of the domed-shaped ends 213,223 of the protrusions 212,222 facilitate their engagement during operation, and discourage lateral "slipping" during use.

Using a container according to the above-described embodiments of the present disclosure, a method of expelling fluid therefrom includes the step of elastically deforming the container to reduce an internal volume thereof. This step includes applying a pressing force to a first wall of the container in a direction toward a second wall of the container for reducing the relative distance between the first and second walls. This compression engages a feature formed on an interior of the first wall with or into a feature formed on an interior surface of the second wall, limiting relative movement of the first sidewall and the second sidewall in a plurality of directions. The method further includes the steps of releasing the pressing force applied to the first sidewall and permitting the container to elastically return to an at least partial undeformed state, and repeating the steps of elastically deforming the container and releasing the pressing force until a predetermined amount of fluid is expelled from the container.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A container, comprising:

a housing defining an internal cavity, including:

a top wall defining a first interior surface of the internal cavity; and a bottom wall defining a second interior surface of the internal cavity at least partially opposing the first interior surface;

a first protrusion extending from the top wall into the internal cavity;

a second protrusion extending from the bottom wall into the internal cavity and in a direction of the first protrusion, the first and second protrusions defining complementary surfaces engaging one another in an at least partially compressed state of the container and limiting relative movement between the first and second protrusions in at least two directions;

wherein at least one of the top wall or the bottom wall is biased in a direction of the other one of the top wall or the bottom wall in the compressed state of the container;

wherein in the compressed state, the first protrusion is at least partially received within a recess formed in the second protrusion; and wherein with the first protrusion and the second protrusion engaged, a fluid channel is open between an exit port and an internal cavity portion upstream from the protrusions.

2. The container of claim 1, wherein with the first protrusion and the second protrusion engaged, relative movement between the first and second protrusions is prevented in at least one direction that is normal to a direction of compression of the top wall relative to the bottom wall.

3. The container of claim 1, wherein with the first protrusion and the second protrusion engaged, relative movement between the first and second protrusions is prevented along a plane defined between the first protrusion and the second protrusion in the compressed state of the container.

4. The container of claim 3, wherein complementary mating surfaces of the first protrusion and the second protrusion at least partially oppose one another in directions normal to a direction of compression of the top wall relative to the bottom wall.

5. The container of claim 1, wherein the first protrusion includes a first component having a first cross-section and extending into the internal cavity, and a second component having a second cross-section distinct from the first cross-section and extending from an end of the first component into the internal cavity.

6. The container of claim 5, wherein the second component comprises a generally cylindrical protrusion and the second protrusion defines a complementary recess receiving the second component in the compressed state of the container.

7. The container of claim 6, wherein a leading edge of at least one of the cylindrical protrusion or the complementary recess is rounded.

8. The container of claim 1, wherein the first protrusion and the second protrusion defined opposing and complementary domed-shaped protruding and recessed ends, respectively.

9. The container of claim 1, wherein the first protrusion and the second protrusion comprise tapered cylinders having complementary engaging end surfaces.

10. The container of claim 1, wherein the housing is formed from a blow-molded polymer material.

* * * * *